US005850063A

United States Patent [19]

Davidson

[11] Patent Number: 5,850,063

[45] Date of Patent: Dec. 15, 1998

[54] DOMED CONTACT ELEMENT FOR A KEYPAD ASSEMBLY

[75] Inventor: Brian James Davidson, Surrey, England

[73] Assignee: Nokia Mobile Phones Limited, Salo, Finland

[21] Appl. No.: 772,130

[22] Filed: Dec. 19, 1996

[30] Foreign Application Priority Data

Dec. 22, 1995 [GB] United Kingdom ..... 9526481

[51] Int. Cl.[6] ..... H01H 5/18

[52] U.S. Cl. ..... 200/406; 200/275; 200/292

[58] Field of Search ..... 200/406, 275, 200/292, 527, 512, 513; 29/622

[56] References Cited

U.S. PATENT DOCUMENTS

| | | | |
|---|---|---|---|
| 3,996,428 | 12/1976 | Buan et al. | 200/5 A |
| 4,172,218 | 10/1979 | Sugisaka | 200/273 |
| 4,343,973 | 8/1982 | Main | 200/159 |
| 4,987,278 | 1/1991 | Tsutsumi | 200/406 |
| 5,136,131 | 8/1992 | Komaki | 200/512 |

FOREIGN PATENT DOCUMENTS 2 331 838 10/1977 France .

OTHER PUBLICATIONS

EPO Communication dated 17 Jun. 1998.

*Primary Examiner*—David J. Walczak
*Attorney, Agent, or Firm*—Perman & Green, LLP

[57] ABSTRACT

A domed contact element 50 for a keypad assembly comprising a substrate (52) having the dome (54) formed therein, the dome being depressible towards the substrate so as to move from a first natural-bias position to a second position; a soldering site (62) on the substrate by which the contact element can be soldered to a circuit board; and a port (56) positioned between the dome (54) and the soldering site (62) to inhibit ingress of solder into the dome (54) during soldering.

9 Claims, 4 Drawing Sheets

DOMED CONTACT ELEMENT FOR A KEYPAD ASSEMBLY

FIELD OF THE INVENTION

The present invention relates to a domed contact element for use in a keypad assembly of an item of electronic apparatus particularly, but not exclusively, a mobile phone.

BACKGROUND OF THE INVENTION

FIGS. 1(*a*) and 1(*b*) show cross-sectional views of one of a plurality of key assemblies making up a typical keypad assembly.

Referring to FIG. 1(*a*), the key assembly, generally designated 10, comprises a body portion 12 defining an aperture 14 and a key 16 mounted in register with the aperture. The key 16 is mounted relative to the body portion 12 by means of a skirt region 18 which is flexible and permits the movement of the key 16 into and out of the aperture 14, when it is depressed, but naturally biases it to occupy the position shown in FIG. 1 (*a*). On their upper surfaces, the key 16, the body portion 12 and the skirt region 18 are painted; the upper surface of the key 16 includes an indicia region 19 which is painted so as to bear an indicia serving to indicate the function of the key 16, for example, an alphanumeric character or other symbol. The key 16 includes a base 20 from which a depending projection or pip 22 centrally projects. The pip 22 is cylindrical and has an exposed end 24. The key 16, including the pip 22, the body portion 12 and the skirt region 18 are made from a single piece of silicon rubber. The key assembly 10 further comprises a contact element 30 having a resiliently distortable dome 32, with an apex 33, which is snappable between bias positions. The contact element 30 is mounted on an underlying circuit board 40, as shown in FIG. 1(*a*), such that a small spacing exists between the exposed end 24 and the outside surface of the dome 32. The inside surface of the dome 32 is conductive. On the circuit board 40, in the region enclosed by the dome 32, a pair of spaced electrical terminals 36 are provided. The dome 32 is distortable so as to snap from a first natural-bias position in FIG. 1 (*a*), in which the electrical terminals 36 are not electrically connected to each other to a second distorted position, as shown in FIG. 1 (*b*), in which the inside of the dome 32 provides electrical connection between the electrical terminals 36.

In use, the user depresses the key 16 causing it to travel into the aperture 14 and thus the exposed end 24 of the pip 22 to bear against the dome 32. The continued travel of the pip 22 causes the continued distortion of the dome 32, until it reaches a condition at which it snaps into the second position shown in FIG. 1 (*b*). The making of the electrical connection between the electrical terminals 36 enables external circuitry (not shown) to register the depression of the key 16. When the key 16 is released, the resilience of the dome 32 propels the key 16 upwardly and the dome 32 resumes its first position as shown in FIG. 1 (*a*). The resilience of the skirt region 18, then causes the key 16 to re-adopt its position in FIG. 1 (*a*).

It is known to provide the contact elements of a known keypad assembly in the form of a structure comprising a layer of adhesive material to which a plurality of individual metal domes are adhered. The individual metal domes are pre-placed at the appropriate position on the layer such that during assembly of the keypad assembly the structure can be fixed in position as a unitary member.

In one aspect, the present invention provides a domed contact element suitable for a keypad assembly, comprising a substrate having the dome formed therein, the dome being resilient and depressible towards the substrate so as to move from a first natural-bias position to a second position; a soldering site on the substrate by which the contact element can be soldered to a circuit board; and means to inhibit ingress of solder into the dome during soldering.

The means to inhibit ingress of solder into the dome soldering can comprise a port positioned between the dome and the soldering site.

In the construction of an item of electronic apparatus with a keypad assembly, the present invention enables the contact elements of the keypad assembly to be individually placed and soldered in position to a circuit board of the apparatus as an integral part of the manufacturing process which places and solders the other components of the apparatus to the circuit board. The present invention thus provides a contact element which is very production friendly.

Preferably, the contact element includes a pick-up site on the substrate by which a pick-and-place machine can vacuum pick-up the contact element.

BRIEF DESCRIPTION OF DRAWINGS

Exemplary embodiments of the invention are herein described with reference to the accompanying drawings, in which.

DETAILED DESCRIPTION OF A PREFERRED EMBODIMENT

Figure 2:
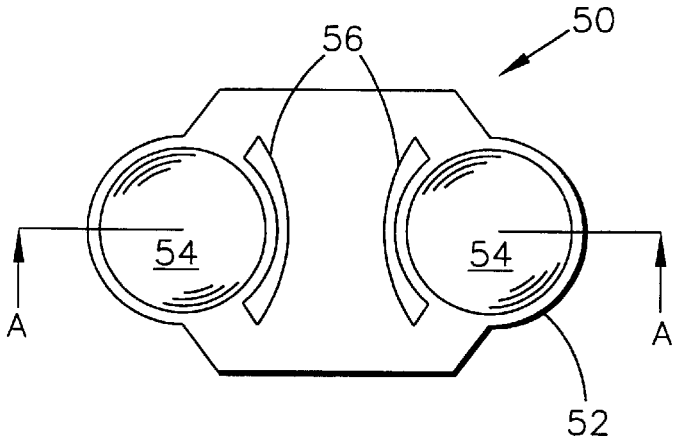
FIG. 2 shows a plan view of a first contact element in accordance with the present invention.
Figure 3:
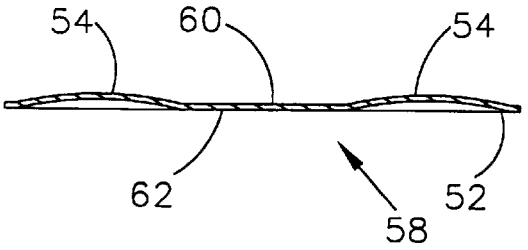
FIG. 3 shows a side view of the first contact element of FIG. 2.
Figure 4:
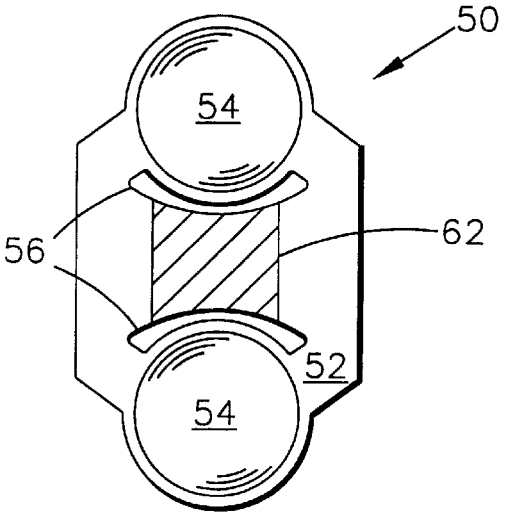
FIG. 4 shows a view from below the first contact element of FIG. 2.
Figure 5:
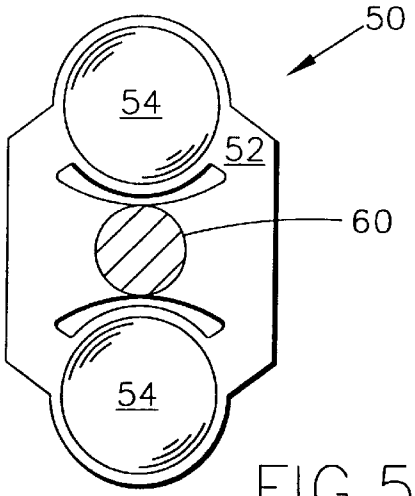
FIG. 5 shows a further plan view of the first contact element of FIG. 2.

Referring to FIGS. 2 and 3, a contact element in accordance with the invention is generally designated 50. It comprises an elongate, planar substrate 52 having a central longitudinal axis indicated by the line A-A$^1$ and a dome 54 upstanding at opposite ends of a first face thereof. A curved hole 56 formed in the substrate 52 adjacent each dome 54 defines an intermediate section 58 of the substrate. On the first face of the intermediate section 58 of the substrate, a flat pick-up site 60 is provided (See FIG. 5). On the second face of the intermediate section 58 of the substrate, a soldering site 62 is provided (See FIG. 4). The first contact element 50 is punched and formed from one piece of metal.

Figure 1A:
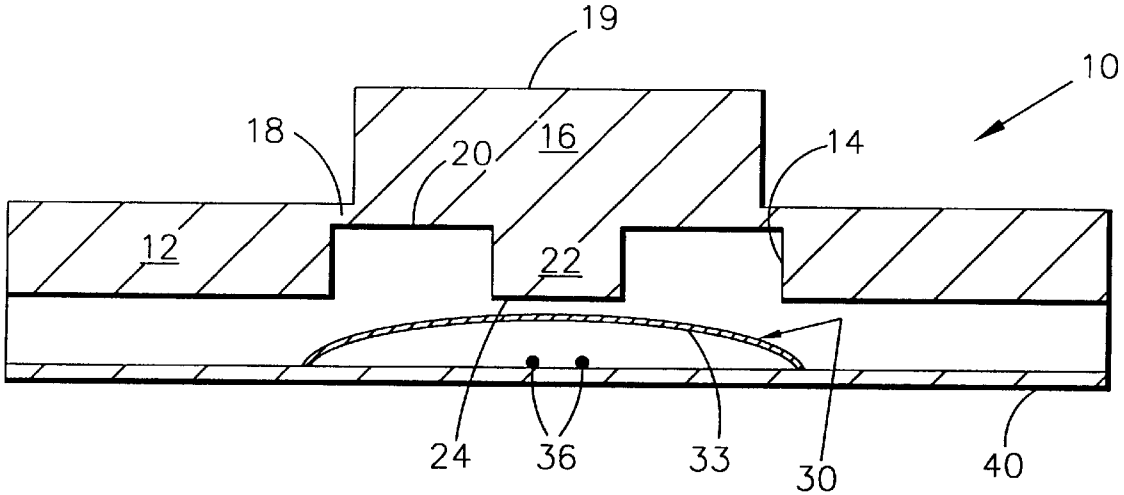
FIG. 1(a) PRIOR ART
FIGS. 1 (*a*) and 1 (*b*) show cross-sectional views of a key assembly.
Figure 1B:
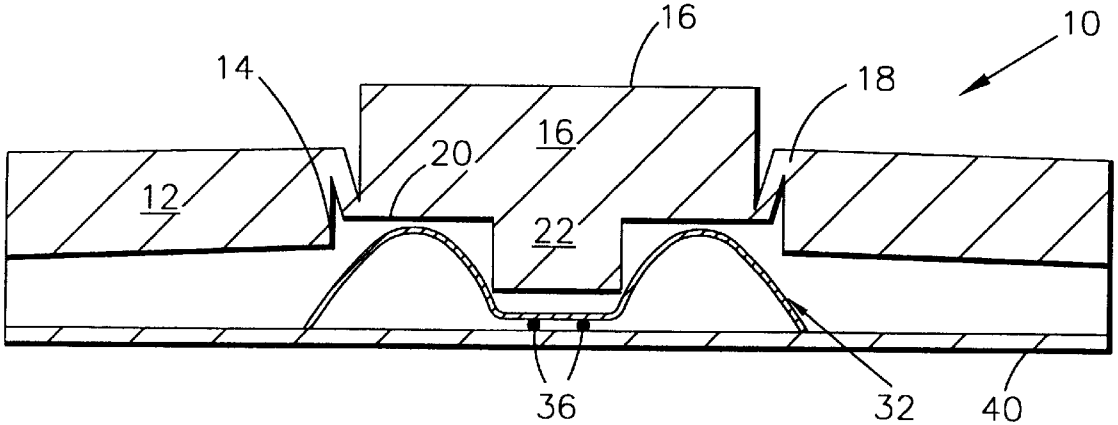
FIG. 1(b) PRIOR ART

The contact element 50 is functionally identical to the contact element 30 in FIGS. 1 (*a*) and 1 (*b*) and is arranged, in use, in the same way.

When assembling an item of electronic apparatus, the contact elements 50 can be mounted to a printed circuit board (PCB) as an integral part of the reflow soldering process which mounts the other components of the apparatus to the PCB. This process is well known in itself and involves, in general terms, taking a PCB having the appropriate conductive tracks and solder paste areas already applied thereto; using a pick-and-place machine to position the components correctly on the PCB; and heating up the PCB and components to melt the solder paste in order to physically and electrically connect the components to the PCB in a permanent fashion. The contact element 50 is picked up by its pick-up site using the suction nozzle of the pick-and-place machine and then placed in position on the circuit board with its soldering site 60 in contact with a solder paste area on the PCB. In this way, the contact element 50 is handled like any other component to be mounted to the PCB. On applying heat, the solder paste area melts and the substrate 52 becomes adhered to the PCB via its soldering site 62. The holes 56 provide a port to inhibit the seepage of solder into the dome area which could adversely affect the action of the domes 54. Any melted solder flowing towards the domer area collects in the area defined by holes 56 rather than progress into the dome area. In this way, the holes 56 serve as a collection duct for melted solder.

In other embodiments of the invention, the ports need not pass completely through the substrate 52 but may take the form of a recess formed in the second face thereof.

Figure 8:
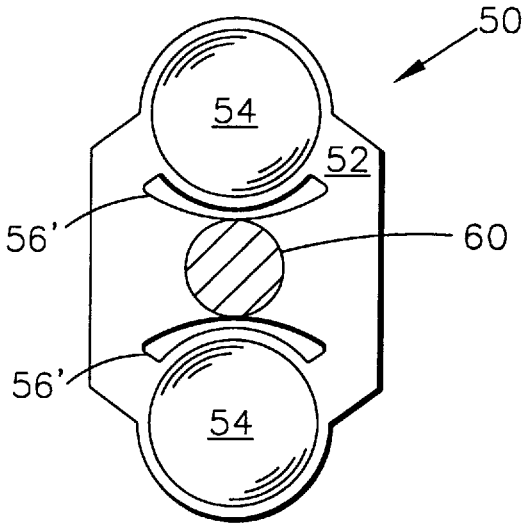
FIG. 8 shows an alternative embodiment using a ridge formation.

In other embodiments, as seen in FIG. 8 in addition to or instead of a port, a guarding formation 56' projects a small distance from the second face of the substrate 52. The guarding formation is positioned between the soldering site 60 and the dome area and has an arcuate shape like that of a hole 56 when viewed in FIG. 4. The guarding formation or ridge provides a barrier which diverts the flow of solder away from the dome area, preferably into collecting ducts or ports.

Figure 6:
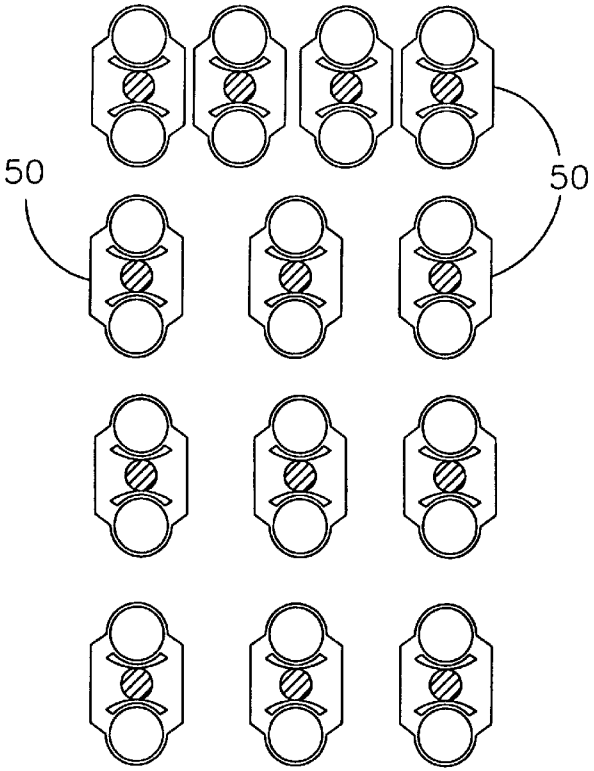
FIG. 6 shows a plurality of the first contact elements in a typical arrangement.

FIG. 6 shows an array of contact elements 50 arranged how they typically might be on a PCB.

Figure 7:
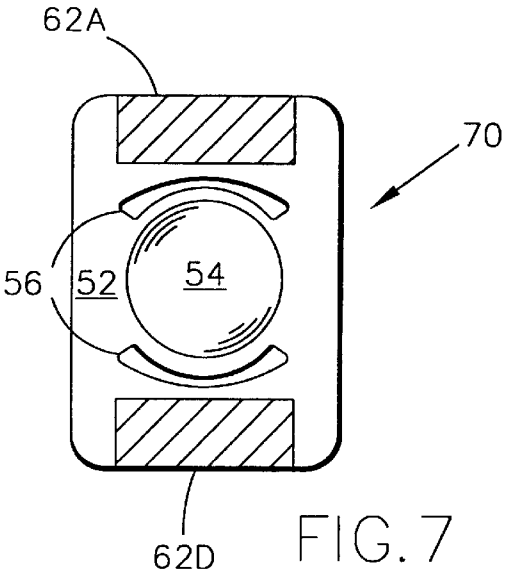
FIG. 7 shows a plan view of a second contact element in accordance with the present invention.

FIG. 7 shows an alternative contact element 70 consisting of only one dome 54 and two soldering sites 62*a*, 62*b*. Like parts have been given the same reference numerals. The pick-up site can be any suitable location on the substrate 52. The contact element 70 is also functionally identical to the contact element 30 in FIGS. 1 (*a*) and 1 (*b*) and is arranged, in use, in the same way.

What is claimed is:

1. A contact element for a keypad assembly comprising:

a substrate having a dome formed therein, the dome being depressible towards the substrate so as to move from a first natural-bias position to a second position;

a soldering site on the substrate by which the contact element can be soldered to a circuit board; and means for collecting solder flowing from the soldering site, during soldering occurring between the substrate and a circuit board, so as to inhibit ingress of solder into the dome.

2. A contact element as in claim 1, further comprising a site by which the contact element can be picked up by suction.

3. A contact element as in claims 1, wherein said means comprises a port positioned between the soldering site and the dome.

4. A contact element as in claim 3, wherein the port comprises a hole passing completely through the substrate.

5. A contact element as defined in claim 1, wherein said substrate has a first face on which is formed a flat pick-up site and has a second face on which the soldering site is located, and wherein said flat pick-up site being disposed centrally of said means for collecting solder.

6. A contact element as defined in claim 1, wherein said substrate includes two soldering sites, said two soldering sites being located at opposite ends of said substrate with said means for collecting solder being disposed therebetween.

7. A method of manufacturing a keypad assembly on a circuit board by providing a plurality of contact elements and placing individually said plurality of contact elements in position on the circuit board using a pick-and-place machine;

providing each of said contact elements with a substrate having a dome formed therein;

providing a soldering site on the substrate by which the contact element can be soldered to a circuit board;

providing means for collecting solder flowing from the soldering site during soldering, so as to inhibit ingress of solder into the dome;

heating said soldering site so as to cause the substrate and said contact element to become soldered to one another; and using said means for collecting solder to inhibit the ingress of solder into the dome once the solder is melted.

8. A domed contact element for a keypad assembly comprising:

a substrate having a dome formed therein, the dome being depressible towards the substrate so as to move from a first natural-bias position to a second position;

a soldering site on the substrate by which the contact element can be soldered to a circuit board; and means for inhibiting ingress of solder into the dome during soldering occurring between the substrate and a circuit board, said means includes a port positioned to collect solder flowing from the soldering site, and wherein the port comprises a hole passing completely through the substrate.

9. A contact element for a keypad assembly comprising:

a substrate having a dome formed therein, the dome being depressible towards the substrate so as to move from a first natural-bias position to a second position;

a soldering site on the substrate by which the contact element can be soldered to a circuit board; and guarding means for diverting solder flowing from the soldering site, during soldering occurring between the substrate and a circuit board, so as to inhibit ingress of solder into the dome.

* * * * *